US007296980B2

(12) United States Patent
Olivieri et al.

(10) Patent No.: US 7,296,980 B2
(45) Date of Patent: Nov. 20, 2007

(54) INTAKE VALVE FOR A HIGH-PRESSURE PUMP, IN PARTICULAR FOR INTERNAL COMBUSTION ENGINE FUEL

(75) Inventors: Davide Olivieri, Bari (IT); Thomas Schwarz, Schorndorf (DE); Giuseppe Ficarella, Bari (IT)

(73) Assignee: Centro Studi Componenti per Veicoli S.p.A., Modugno (IT)

( * ) Notice: Subject to any disclaimer, the term of this patent is extended or adjusted under 35 U.S.C. 154(b) by 281 days.

(21) Appl. No.: 10/494,186

(22) PCT Filed: Oct. 30, 2002

(86) PCT No.: PCT/IT02/00692

§ 371 (c)(1),
(2), (4) Date: Nov. 30, 2004

(87) PCT Pub. No.: WO03/038270

PCT Pub. Date: May 8, 2003

(65) Prior Publication Data

US 2005/0079082 A1 Apr. 14, 2005

(30) Foreign Application Priority Data

Oct. 30, 2001 (IT) ..... TO2001A1039

(51) Int. Cl.
*F04B 1/04* (2006.01)

(52) U.S. Cl. ..... 417/273; 417/571; 417/454

(58) Field of Classification Search ..... 417/454, 417/53, 273, 569, 571, 298, 570; 123/506; 137/529, 512.3
See application file for complete search history.

(56) References Cited

U.S. PATENT DOCUMENTS

| | | | | |
|---|---|---|---|---|
| 600,841 | A | 3/1898 | Oderman | 417/558 |
| 4,127,362 | A | 11/1978 | Fladby | 417/53 |
| 4,570,849 | A | 2/1986 | Klaucke et al. | 236/35 |
| 5,701,873 | A | 12/1997 | Schneider | 123/516 |
| 6,224,350 | B1 | 5/2001 | Guentert et al. | 417/273 |
| 6,568,927 | B1 | 5/2003 | Guentert et al. | 417/569 |
| 2001/0005485 | A1 | 6/2001 | Mori | 417/569 |

FOREIGN PATENT DOCUMENTS

DE 198 60 672 7/2000

*Primary Examiner*—Anthony Stashick
*Assistant Examiner*—Vikansha Dwivedi
(74) *Attorney, Agent, or Firm*—Baker & Daniels LLP

(57) ABSTRACT

An intake valve for a high pressure pump for internal combustion engine fuel having a valve body having a seat with which cooperates a shutter kept closed by a first spring of substantially constant pressure and by a second spring varying in pressure during at least part of the stroke of the piston. The springs are helical compression types and their pressures are summed on the shutter, which has a plate and a stem. The first spring is located between the valve body and a flange integral with a sleeve fitted to the stem in an adjustable position. The second spring is located between the plate and the piston.

16 Claims, 3 Drawing Sheets

INTAKE VALVE FOR A HIGH-PRESSURE PUMP, IN PARTICULAR FOR INTERNAL COMBUSTION ENGINE FUEL

BACKGROUND OF THE INVENTION

1. Technical Field

The present invention relates to an intake valve for a high-pressure pump, in particular for internal combustion engine fuel.

2. Background Art

As is known, the fuel injected into internal combustion engine cylinders must be compressed to around 1600-bar pressure. Modern feed systems comprise a high-pressure piston pump for feeding the compressed fuel to a common rail communicating with the various engine injectors, and which in turn is supplied with fuel at around 5-bar pressure by a low-pressure pump.

Each pump cylinder has an intake valve comprising a shutter normally closed by a spring, and which opens the valve when the difference in the fuel supply pressure in the cylinder exceeds the force or pressure exerted by the spring on the shutter.

The pump normally comprises a group of radial pistons, e.g. three pistons spaced 120° apart, which are activated by a common cam actuator fitted to a shaft; and each shutter spring is appropriately calibrated, but so located that its pressure is unaffected by the position of the relative piston.

The above known intake valve (valve 1) has various drawbacks, by resulting in unbalance of both the operating shaft and the delivery pressure of the cylinders when low flow, e.g. less than 30% of maximum flow, is demanded of the pump.

That is, the delay with which the various valves open varies, so that the pistons compress different amounts of fuel. In very low flow conditions, as when the engine is run at idling speed, some of the valves may not even open at all, so that unbalance of the operating shaft of the pump is considerable and greatly reduces the working life of the pump. Moreover, given its high elastic constant, the spring can only be calibrated within a tolerance range relatively wide.

To reduce the unbalance on the pump caused by the intake valve described above, a high-pressure pump has recently been proposed in which the shutter spring is located between the shutter and the piston (valve 2), so that, during the intake stroke of the piston, the pressure of the spring is reduced rapidly, while still allowing the valve to open.

The above known valve 2 has a valve body with a substantially truncated-cone-shaped lateral surface. The valve body is fixed to the cylinder by a ring nut acting on the lateral surface, and has an intake conduit sloping with respect to the valve body axis.

This known valve 2 also has several drawbacks. In particular, the shutter spring has a high elastic constant and therefore requires a considerable pressure drop to open; on account of its location, the spring cannot be calibrated, so that numerous versions of the spring must be provided for different applications; the shape of the valve body makes automated preassembly of the valve difficult; and, finally, location of the intake conduit weakens the valve body, which, in use, is subject to cracking.

From document U.S. Pat. No. 5,701,873, it is also known a piston pump having a coaxial intake valve, the shutter of which is kept closed by the sum of pressures of two different helical compression springs. One of these springs is relatively strong and permanently exerts a closing pressure on the shutter, whereas the other spring is relatively weak and is supported on a spring plate, which is axially displaceable in a chamber communicating with the intake fluid for damping purpose.

SUMMARY OF THE INVENTION

It is an object of the invention to provide a high-pressure pump intake valve enabling calibration of the opening pressure of the shutter, and which is easy to preassemble, is highly reliable and durable, and eliminates the aforementioned drawbacks typically associated with known intake-valves.

According to the present invention, there is provided an intake valve for a high-pressure pump, in particular for internal combustion engine fuel, having at least one cylinder, and a corresponding piston sliding therein through an intake stroke and a compression stroke; said valve comprising a seat coaxial with said cylinder and cooperating with an axially movable shutter; and a pair of compression helical springs for keeping closed said shutter, said shutter being opened during said intake stroke in opposition to the sum of pressures of said springs; a first one of said springs being a substantially constant pressure, said constant pressure being adjustable; a second one of said springs being located between said shutter and said piston so that the relevant pressure decreases sinusoidally during said intake stroke and increases sinusoidally during said compression stroke.

More specifically, the pressures of the two springs are summed on the shutter, and the pressure of the first spring is adjustable; said seat is carried on the valve body; the shutter is a mushroom type having a plate engaging said seat, and a stem extending in an opposite direction to the piston; the two springs are helical compression types; the first spring is located between the valve body and a flange fixed to the stem in an axially adjustable position; the second spring is located between the plate and the cylinder; and the ratio between the pressure of the first spring and that of the second spring at the bottom dead center position of the piston ranges between 1.5 and 6.

BRIEF DESCRIPTION OF THE DRAWINGS

A preferred, non-limiting embodiment of the invention will be described by way of example with reference to the accompanying drawings, in which.

DETAILED DESCRIPTION

Figure 6:
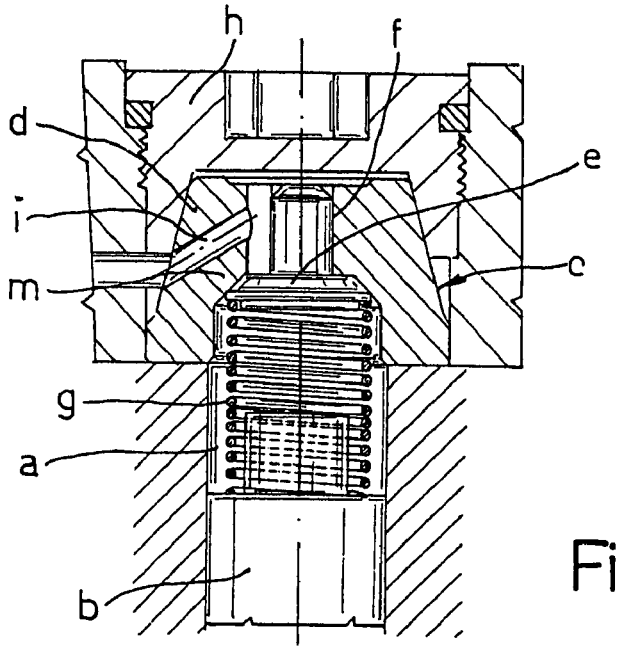
Fig.6 Prior Art
FIG. 6 shows a partial longitudinal section of a known intake valve.

With reference to FIG. 6, a known high-pressure pump comprises a cylinder a in which slides a piston b; and an intake valve c (valve 2) carried by a valve body d having a truncated-cone-shaped lateral surface. Valve c is defined by a mushroom-shaped shutter comprising a plate e coaxial with cylinder a and guided inside a hole f in valve body d. A spring g is located between plate e and a shoulder of piston b, and acts variably on plate e during the stroke of piston b.

Spring g must provide a given opening pressure also at the bottom dead center position of piston b, and therefore has a high elastic constant. Valve body d is fixed to cylinder a by a threaded ring nut h having a cavity complementary in shape to that of body d, and has an intake conduit i which must leave the edge of ring nut h free. Intake conduit i therefore slopes, and forms in valve body d a weak region m which is easily cracked as a result of the impact of plate e.

Figure 1:
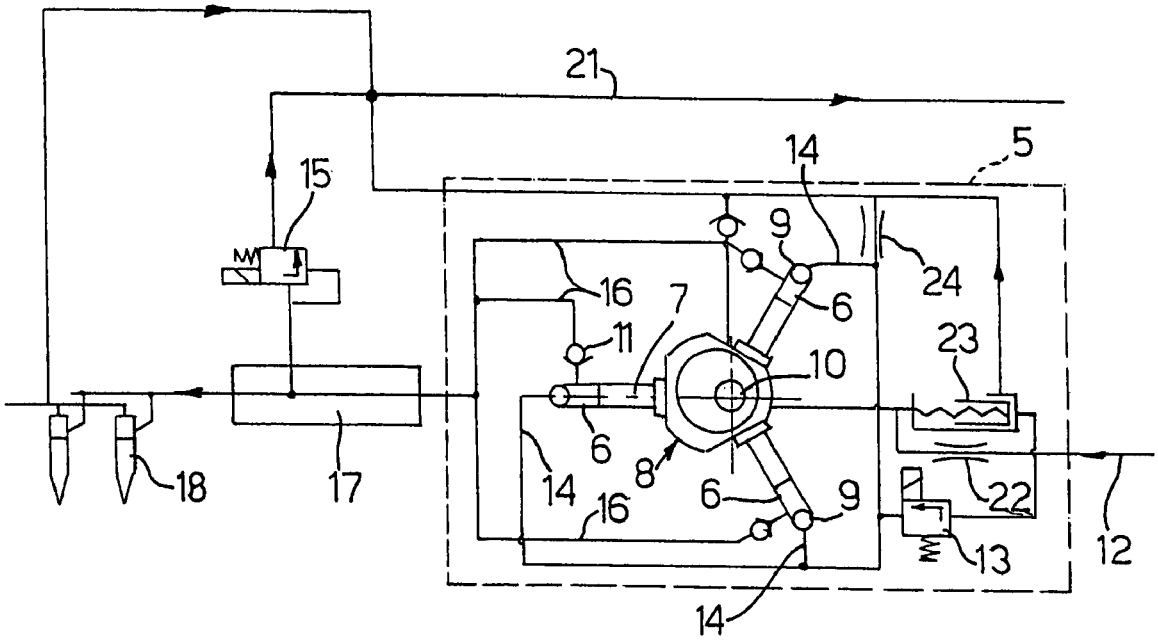
FIG. 1 shows a diagram of a radial-piston pump, for internal combustion engine fuel, in which each cylinder is equipped with an intake valve in accordance with the invention.

With reference to FIG. 1, number 5 indicates as a whole a high-pressure pump for internal combustion, e.g. diesel, engine fuel. Pump 5 is a radial-piston type, and comprises three cylinders 6 spaced 120° apart, and in each of which slides a corresponding piston 7. The three cylinders 6 are carried by a common pump body, which forms a closed central operating chamber housing a cam actuator 8 carried by a shaft 10 and common to all three pistons 7.

Each cylinder 6 is equipped with an intake valve indicated as a whole by 9; and with a delivery valve 11. The three intake valves 9 are supplied by a low-pressure pump (not shown) by means of a feed conduit 12, an electromagnetic proportional inlet valve 13, and three inlet conduits 14.

The three delivery valves 11 are connected to three corresponding delivery conduits 16 communicating with a high-pressure fuel common rail 17, which supplies a series of injectors 18 of the internal combustion engine cylinders in known manner. Injectors 18 are controlled electromagnetically but-activated in known manner by the pressurized fuel in common rail 17.

Common rail 17 is fitted with an overpressure valve 15 by which any surplus fuel is drained into a return conduit 21 at atmospheric pressure; the fuel used to operate injectors 18 is also fed to return conduit 21; and, to lubricate the bearings of shaft 10 and the contact surfaces of cam actuator 8 and pistons 7, feed conduit 12 supplies a certain amount of fuel into the central chamber of the pump body via a choke 22 and an overpressure valve 23.

The lubricating fuel from both the central chamber and overpressure valve 23 is fed to return conduit 21. To dispose of fuel leakage through proportional inlet valve 13, the incoming fuel pressure is greater than the return pressure, and inlet conduits 14 communicate with return conduit 21 via a choke 24.

High-pressure pump 5 is normally supplied by the low-pressure pump with fuel at around 5-bar pressure, and supplies common rail 17 with around 1600-bar pressure; and the intake valve 9 of each cylinder 6 should be calibrated to open at a roughly 1.8-bar pressure drop, but with a roughly 0.01-bar tolerance.

Figure 2:
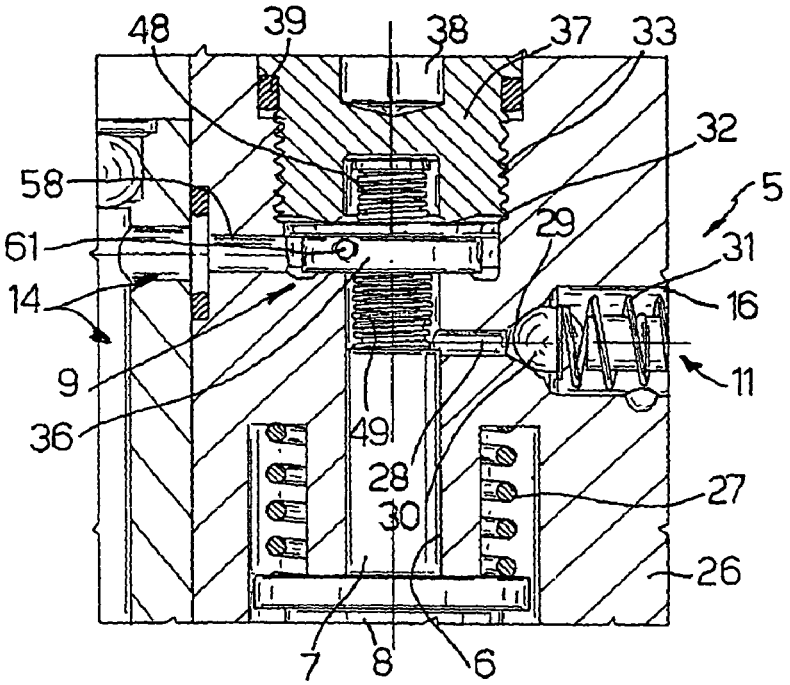
FIG. 2 shows a partial longitudinal section of a cylinder of the FIG. 1 pump.

With reference to FIG. 2, pump 5 comprises a pump body 26 with three cylinders 6 (only one shown). In each cylinder 6 slides a corresponding piston 7, which is pushed towards cam actuator 8 (see also FIG. 1) by a corresponding compression spring 27, so that, as cam actuator 8 rotates, the three pistons 7 are activated sequentially to perform an intake stroke between a top dead center position and a bottom dead center position, and a compression stroke in the opposite direction; both strokes being performed in harmonic motion. More specifically, the intake stroke is performed negatively by spring 27, and the compression stroke positively by cam actuator 8.

Delivery conduit 16 of each cylinder 6 (see also FIG. 3) comes out inside cylinder 6 through a hole 28 forming a conical seat 29 for delivery valve 11, which comprises a ball shutter 30 pushed against seat 29 by a compression spring 31. At the outer end, each cylinder 6 communicates with a coaxial cylindrical opening 32, which is larger in diameter than cylinder 6, has a threaded axial portion 33, and forms an annular shoulder 34 with cylinder 6.

Intake valve 9 of each cylinder 6 comprises a valve body 36 defined by a cylindrical plate. Valve body 36 is housed inside opening 32 and held resting on shoulder 34 by a threaded ring nut 37 having a projecting edge 35 at the bottom, and a hexagonal socket 38 at the top for an Allen wrench.

Using an Allen wrench, and with the interposition of a low-pressure fuel seal 39, ring nut 37 is screwed inside threaded portion 33 of opening 32 until edge 35 effectively forces valve body 36 against shoulder 34, so that valve body 36 forms the end surface of cylinder 6.

Intake valve 9 comprises an opening 41 formed in valve body 36 and forming at the bottom a conical seat 42 coaxial with cylinder 6. Conical seat 42 is closed by a mushroom-type shutter 43, which comprises a plate 44 carried by a cylindrical stem 46 extending in the opposite direction to piston 7 and housed in a cavity 40 in ring nut 37. Plate 44 has a conical annular surface 45 hermetically engaging conical seat 42; and shutter 43 is movable axially between a closed position closing seat 42 (FIG. 2), and an open position opening seat 42. For which purpose opening 41 comprises an axial portion 47 for axially guiding stem 46 of shutter 43.

According to the invention, shutter 43 is kept in the closed position by elastic means comprising a first spring 48 and a second spring 49: the first spring 48 acting on shutter 43 with substantially constant force or pressure during the movement of the corresponding piston 7; and the second spring 49 acting on shutter 43 with a pressure varying during at least a portion of the movement of piston 7. More specifically, both springs 48 and 49 are helical compression types and act on shutter 43 by summing the respective pressures.

First spring 48 is located between a recess 51 of opening 41, in the top surface of valve body 36, and a flange 52 carried by a sleeve 53 fixed to stem 46 of shutter 43. More specifically, sleeve 53 has an inside diameter interfering slightly with the outside diameter of stem 46, and is force-fitted onto stem 46 in an adjustable position, so as to calibrate the pressure of spring 48 extremely accurately.

Second spring 49 is located between plate 44 and piston 7. For which purpose, plate 44 has an underside recess 54 on which one end of spring 49 rests, and piston 7 has a smaller-diameter portion 56 forming a shoulder 57 on which rests the other end of spring 49. In the top dead center position of piston 7, the free end of portion 56 is obviously positioned a given minimum distance from the bottom surface of plate 44, so that the pressure of spring 49 on plate 44 therefore decreases sinusoidally during the intake stroke of piston 7, and increases sinusoidally during the compression stroke of piston 7.

Figure 3:
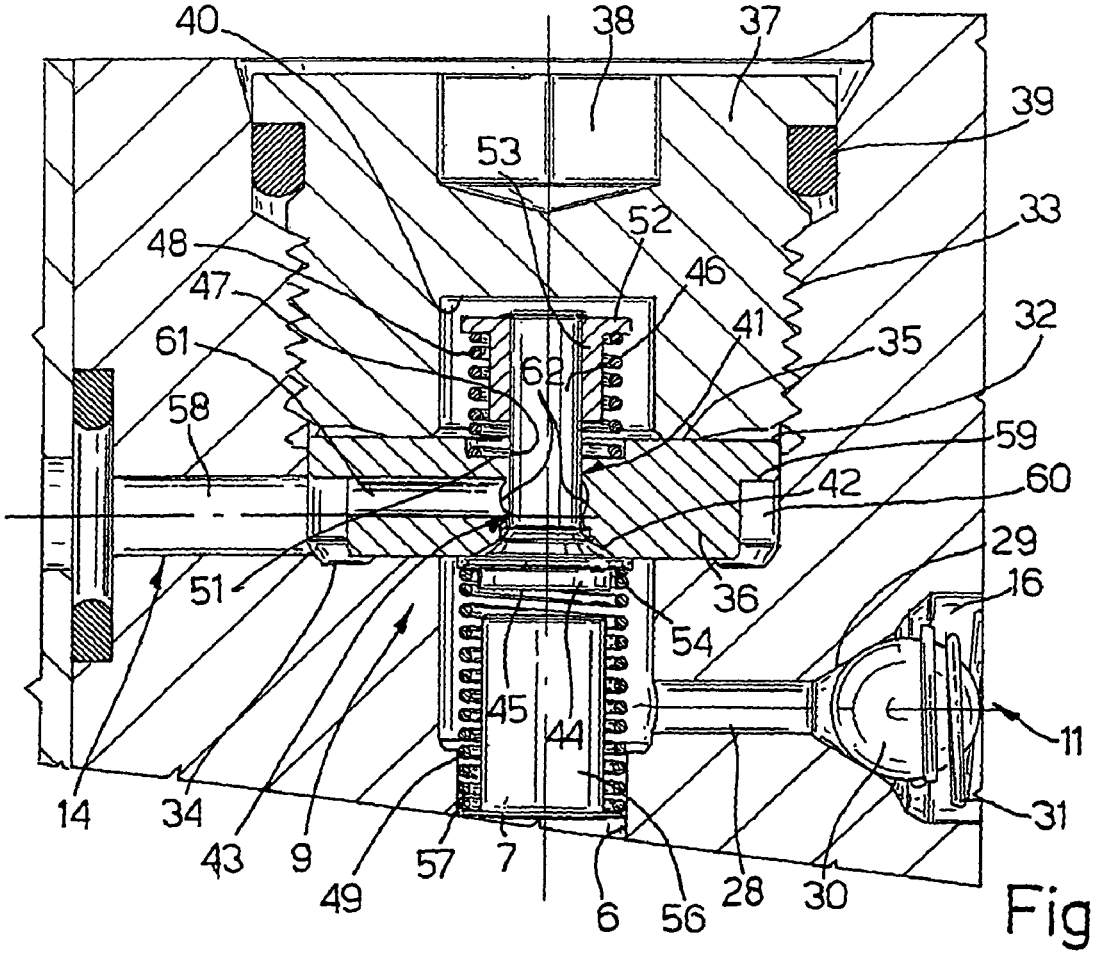
FIG. 3 shows a larger-scale detail of FIG. 2.

Hole 28 of delivery conduit 16 comes out inside cylinder 6 at portion 56 of piston 7, when the piston is in the top dead center position as shown in FIG. 3. Inlet conduit 14 of intake valve 9 comprises a radial hole 58 of cylinder 6, which comes out inside the corresponding cylindrical opening 32 of cylinder 6 at valve body 36. For which purpose, the lateral surface of valve body 36 has a recess 59 which, together with the lateral wall and shoulder 34 of opening 32, forms an annular channel 60. Inlet conduit 14 also comprises a radial hole 61 of valve body 36, which comes out inside an annular groove 62 of opening 41.

The pressure exerted by first spring 48 is less than that of second spring 49, and is preferably selected as low as possible to reduce its elastic constant.

For intake valve 9 to open when the fuel pressure in cylinder 6 falls below a value ranging between 1.3 and 5 bars, the total pressure on plate 44 is obtained by adding the pressures of first spring 48 and second spring 49 with a ratio ranging between 1.5 and 6. More specifically, with a roughly 2.3-bar total pressure value, first spring 48 may be designed to ensure a roughly 1.8-bar constant pressure on plate 44, and second spring 49 may be designed to vary in pressure so as to ensure a 0.5-bar intake opening pressure on plate 44. Tests have shown that, with the above pressure values of springs 48 and 49, spring 48 can be calibrated between 1 and 5 bars, with a tolerance of ±0.05 bar.

Accordingly, the ratio of the elastic constant of first spring 48 to that of second spring 49 may range between 1 and 20. Advantageously, the elastic constant of the first spring may be less than 1 N/mm, e.g. between 0.1 N/mm and 0.8 N/mm, and that of second spring 49 may be around 0.07 N/mm.

Figure 4:
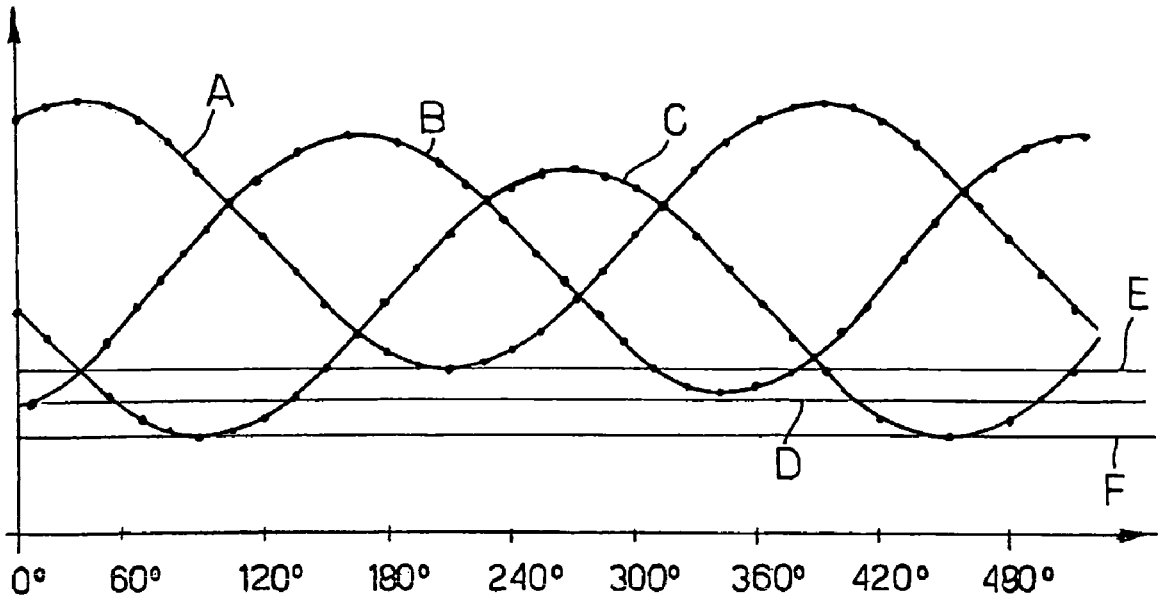
FIG. 4 shows a graph of the opening pressure of the pump intake valves.

Operation of pump 5 and intake valve 9 is obvious, and therefore requires no further explanation. In FIG. 4, each curve A, B and C shows, as a function of the rotation angle of shaft 10, the opening pressure required by plate 44 for variable spring 49 of corresponding intake valve 9 for pump 5; line D shows the nominal constant opening pressure required for constant spring 48; and the maximum and minimum pressure differences of the three variable springs 49 depend on various factors, and must fall within the range indicated by lines E and F.

Figure 5:
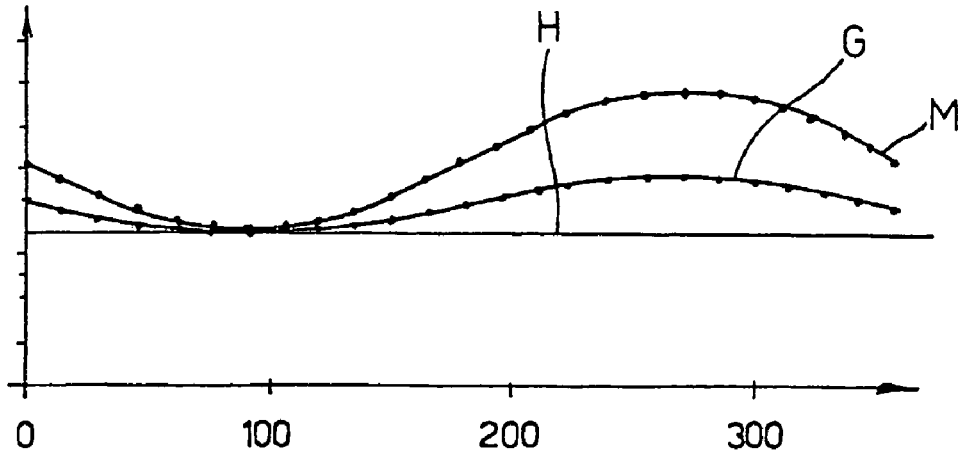
FIG. 5 shows a graph of the opening pressure of the intake valve according to the invention as compared with that of a known valve.

In FIG. 5, curve G shows the opening pressure required by plate 44 as a function of the rotation angle of shaft 10, when plate 44 is kept closed by two springs 48 and 49; and line H shows the constant opening pressure of known valve 1.

Curve M, on the other hand, shows the variable pressure of spring g in FIG. 6, i.e. the pressure required by the plate of known valve 2. As can be seen, much less force is required of spring 49 than spring g in FIG. 6, so that spring 49 can be made of smaller-diameter music wire, thus greatly reducing its size and elastic constant. The lower elastic constant of spring 49 reduces the mean opening pressure of valve 9, thus increasing fuel intake into the cylinder and improving the efficiency of pump 5.

The advantages of the intake valve according to the invention, as compared with those of known pumps, will be clear from the foregoing description. In particular, neither spring 48 nor spring 49 generates the entire opening pressure of valve 9, so that both have a lower elastic constant; constant spring 48 can be calibrated easily to meet the requirements of different applications; variable spring 49 may have a low elastic constant, thus reducing its size about portion 56 of piston 7; the cylindrical shape of valve body 36 and the radial location of hole 58 do not overly weaken valve body 36, thus reducing the risk of in-service cracking; and, finally, to fit valve 9 to respective cylinder 6, the valve 9 assembly, defined by valve body 36, shutter 43, spring 48 and sleeve 53, can be preassembled easily.

Clearly, changes may be made to the intake valve as described herein without, however, departing from the scope of the accompanying claims. For example, valve body 36 may have more than one radial hole 58; the ratios between the elastic constants of springs 48 and 49, or the respective absolute values, may be different; and variable-pressure spring 49 may be designed to only vary in pressure during part of the relative piston stroke.

Given the possibility of calibrating spring 48, the same springs 48, 49 can be used for mass producing intake valves 9 for different pump 5 models, thus reducing manufacturing cost; pump 5 may have a different number of cylinders 6, which may be activated by independent actuators; and finally, each piston 7 may be activated positively at both strokes, e.g. by a connecting rod and crank mechanism.

The invention claimed is:

1. An intake valve for a high-pressure pump, in particular for internal combustion engine fuel, having at least one cylinder and a corresponding piston sliding therein through an intake stroke and a compression stroke; said valve comprising a seat coaxial with said cylinder and cooperating with an axially movable shutter, and a pair of compression helical springs for keeping closed said shutter, said shutter being opened during said intake stroke in opposition to the sum of pressures of said springs; a first one of said springs being of a substantially constant pressure, said constant pressure being adjustable; a second one of said springs being located between and in contact with said shutter and said piston so that the relevant pressure decreases sinusoidally during said intake stroke and increases sinusoidally during said compression stroke.

2. A valve as claimed in claim 1, wherein said seat is carried by a valve body closing said cylinder; and said shutter is a mushroom type having a plate and a stem extending in an opposite direction to said piston; wherein said first spring is located between said valve body and a flange fixed to said stem in an adjustable axial position so as to calibrate accurately the pressure of said first spring, said second spring being located between said plate and said piston.

3. A valve as claimed in claim 1, wherein for a total opening pressure of the valve of 1 to 4 bars, the ratio between the constant pressure of said first spring and the pressure of said second spring at the bottom dead center position of said piston ranges between 1.5 and 6.

4. A valve as claimed in claim 2, wherein said first spring is adjustable within a range of 1 to 5 bars.

5. A valve as claimed in claim 3, wherein the ratio between the elastic constant of said first spring and the elastic constant of said second spring ranges between 1 and 20.

6. A valve as claimed in claim 5, wherein the valve opening pressures provided by said first spring and said second spring are in the order of 1.8 and 0.5 bar respectively.

7. A valve as claimed in claim 6, wherein the elastic constant of said first spring is less than 1 N/mm, and the elastic constant of said second spring is in the order of 0.07 N/mm.

8. A valve as claimed in claim 3, wherein said flange is integral with a sleeve which is fitted to said stem in said adjustable position.

9. A valve as claimed in claim 8, wherein the position of said sleeve on said stem is so adjustable that the opening pressure generated by the first spring can be calibrated with a tolerance of at least ±0.05 bar.

10. A valve as claimed in claim 8, wherein said seat is coaxial with said cylinder and has a truncated-cone-shaped surface engaged by a corresponding truncated-cone-shaped surface of said plate; and wherein said plate has a diameter substantially equal to that of said piston said second spring being housed between a recess in said plate and a shoulder formed on a smaller-diameter portion of said piston.

11. A valve as claimed in claim 10, wherein said seat is carried by an opening in said valve body; said opening comprising a portion for guiding said stem; wherein said valve body is defined by a cylindrical plate; said cylinder being provided with an inlet conduit; a radial hole in said cylindrical plate; said radial hole communicating with an annular groove of said portion of the opening, and with an annular channel defined by a recess in said cylindrical plate that is in communication with said inlet conduit.

12. A valve as claimed in claim 11, wherein said cylindrical plate is fixed inside a cylindrical opening coaxial with said cylinder; and including a threaded ring nut having a projecting annular edge engaging a flat surface of said cylindrical plate.

13. A high-pressure pump having an intake valve as claimed in claim 10, wherein said cylinder has a delivery valve located at said smaller-diameter portion and communicating with a pressurized-fuel common rail for supplying a series of fuel injectors.

14. A pump as claimed in claim 13, wherein the pump is provided with three radial cylinders each one having a corresponding inlet conduit, and with a common cam actuator for activating the corresponding pistons in sequence; said inlet conduits communicating with a return conduit, for recirculating fuel from said pump and/or from said common rail, via a choke for controlling the fuel pressure in said inlet conduits.

15. A high-pressure pump for internal combustion engine fuel, comprising: at least one cylinder and a corresponding piston sliding through an intake stroke and a compression stroke; an intake valve comprising a seat coaxial with said cylinder and cooperating with a shutter, and a pair of helical springs for keeping closed said shutter; said shutter being opened during said intake stroke in opposition to the sum of pressures of said helical springs; a first one of said springs being of substantially constant pressure and a second one of said springs being located between and in contact with said shutter and said piston so that the relevant pressure decreases sinusoidally during said intake stroke and increases sinusoidally during said compression stroke.

16. A high-pressure pump for internal combustion engine fuel, comprising: at least one cylinder and a corresponding piston sliding through an intake stroke and a compression stroke; an intake valve comprising a seat coaxial with said cylinder and cooperating with a shutter, and a pair of helical springs for keeping closed said shutter; said shutter being opened during said intake stroke in opposition to the sum of pressures of said helical springs; a first one of said springs being of substantially constant pressure and a second one of said springs being located between and in contact with said shutter and said piston and acted on by said piston so that the relevant pressure decreases sinusoidally during said intake stroke and increases sinusoidally during said compression stroke.

* * * * *